United States Patent [19]

Fabricant

[11] 4,223,894

[45] Sep. 23, 1980

[54] FLOATING TARGET AND WATER PROJECTOR TOY

[76] Inventor: Norman Fabricant, 94-19 64th Rd., Rego Park, N.Y. 11374

[21] Appl. No.: 27,954

[22] Filed: Apr. 9, 1979

[51] Int. Cl.[3] ..... A63F 9/02; F41B 9/00

[52] U.S. Cl. ..... 273/349; 46/93; 222/78; 273/350; 273/386; 273/389

[58] Field of Search ..... 273/101, 102 R, 102.1 R, 273/102.1 C, 102.1 E, 349, 350, 386, 389; 222/78, 79; 141/21, 22, 25, 26; 46/93

[56] References Cited

U.S. PATENT DOCUMENTS

| | | | |
|---|---|---|---|
| 536,176 | 3/1895 | Austin et al. | 273/98 |
| 825,270 | 7/1906 | Gulliford | 222/79 |
| 3,434,716 | 3/1969 | Schwartz | 273/101 |

FOREIGN PATENT DOCUMENTS

| | | | |
|---|---|---|---|
| 905948 | 4/1955 | Fed. Rep. of Germany | 222/78 |
| 163866 | 6/1921 | United Kingdom | 273/102 R |

*Primary Examiner*—Anton O. Oechsle
*Attorney, Agent, or Firm*—Alan H. Levine

[57] ABSTRACT

A water toy including a float, which may be in the form of a boat, carrying one or more target members. The target members may be mounted on the boat deck and be rotatable or vibratable with respect to the float. A manually-operable pump means has an open end submersible in the water on which the float floats and a nozzle through which a stream of water is directed at the target members. The pump means may include a squeezable bulb between its submersible end and the nozzle, and one way valves may be included in the submersible end and the nozzle. The pump means is removably mountable on the float when not in use.

1 Claim, 4 Drawing Figures

FLOATING TARGET AND WATER PROJECTOR TOY

This invention relates to toys, and more particularly to a combined floating water toy and target toy.

It is an object of the invention to provide a floating toy, preferably in the form of a miniature boat, with which a child can play in shallow water, such as in a bathtub.

It is another object of the invention to provide such a toy including a manually-operable pump means for directing a stream of water at movable targets carried by the float part of the toy.

It is a further object of the invention to provide such a toy wherein the pump means has an inlet submersible in the body of water on which the toy floats and is operable to project a stream of water while its inlet end is submerged.

It is an additional object of the invention to provide such a toy wherein the pump means, when not in use, can be removably mounted on the float part of the toy in such a way that it appears to be a natural part of the float.

Other objects and features of the invention will be apparent from the following description in which reference is made to the accompanying drawings.

Figure 1:
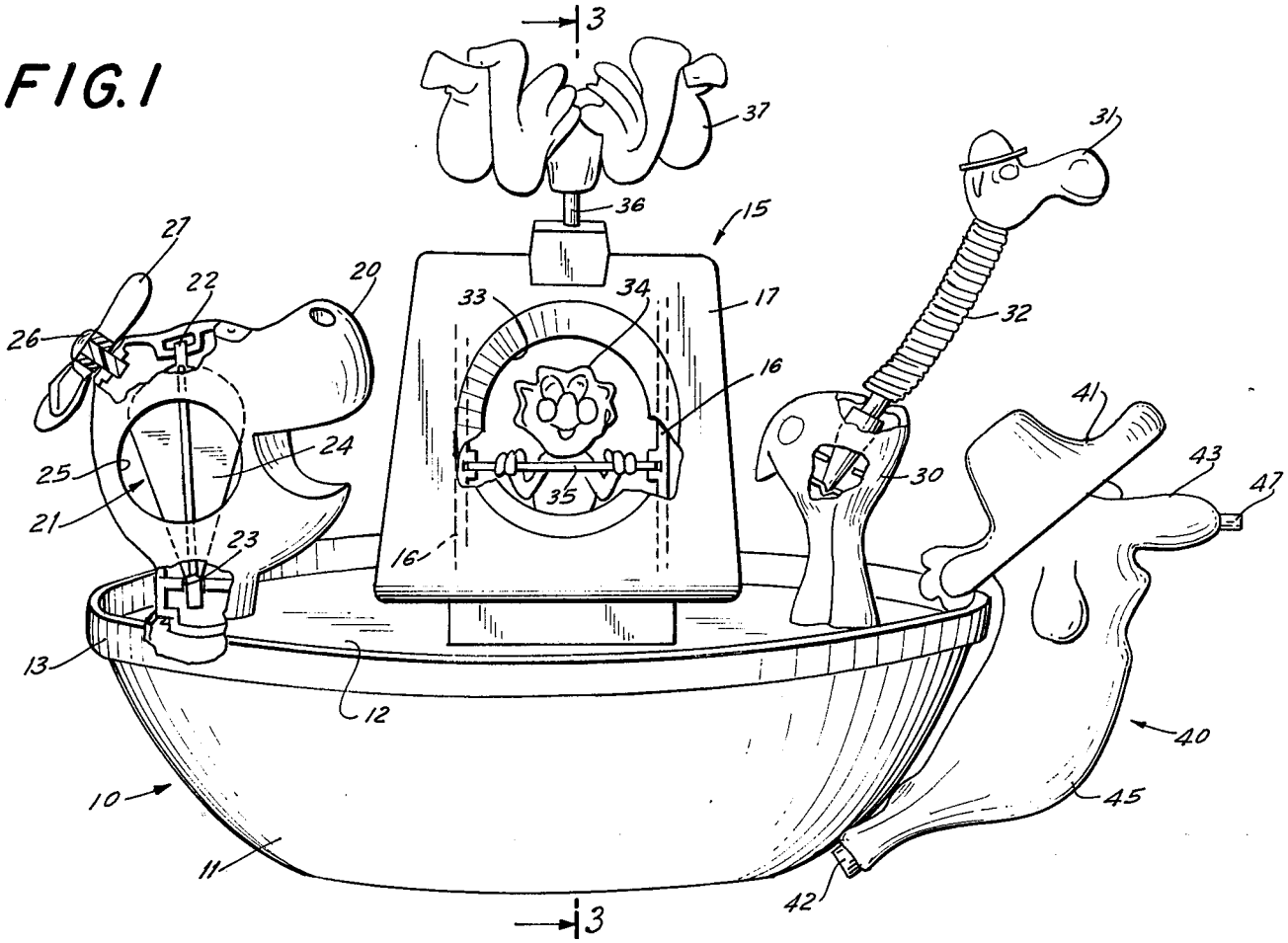
FIG. 1 is a perspective view of a water toy according to this invention, the pump means being shown removably assembled with the float part of the toy.
Figure 2:
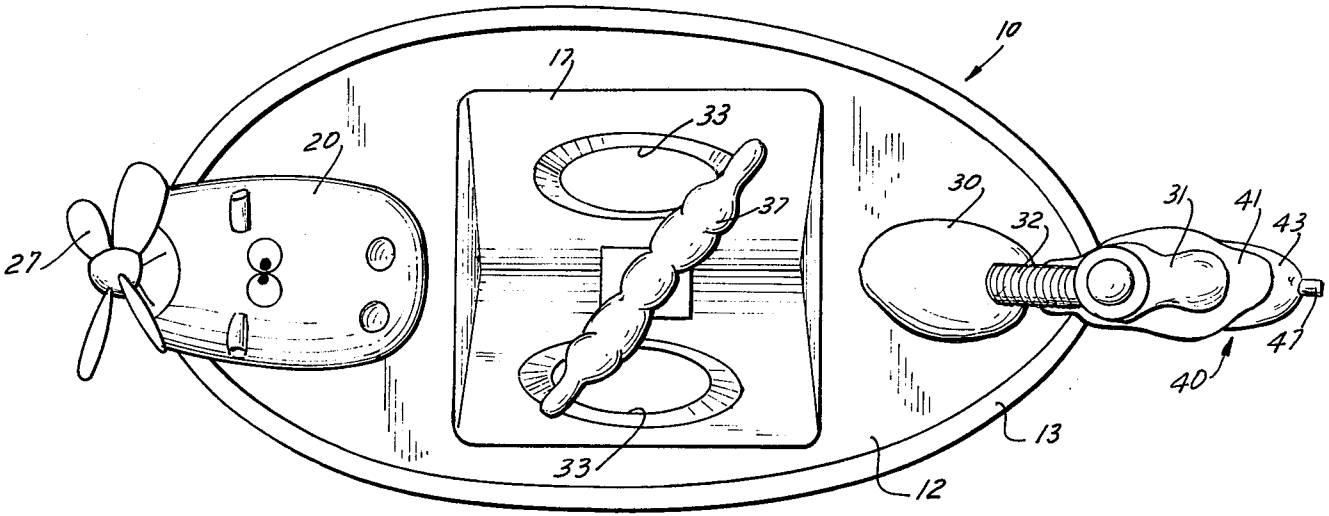
FIG. 2 is a top view of the toy.

The water toy chosen to illustrate the present invention includes a float 10 in the form of a miniature boat. The boat comprises a hull 11, the top of which is closed by a deck 12; deck 12 has a peripheral lip 13 fitted over the top edge 14 of hull 11 and permanently joined to that edge, such as by a suitable cement. Mounted on deck 12 is a cabin 15 having two triangular walls 16 supporting a pitched roof 17.

Also carried by deck 12 are a number of target members. Behind cabin 15, a hollow body 10, resembling the head of a hippopotamus, is fixed to deck 12. Within body 20 is a target member 21 journaled at 22 and 23 for rotation about a vertical axis. Target member 21 has four vanes 24 arranged 90° apart, the vanes being exposed through enlarged holes 25 (only one being seen in FIG. 1) in the sides of body 20. A short post 26 projects from body 20 and carries another target member in the form of a propeller 27.

In front of cabin 15, another body 30, resembling the body and legs of a giraffe, is fixed to deck 12. A target member 31, in the form of the giraffe's head, is connected to body 30 by a length of springy material 32 serving as the neck of the giraffe. Material 32 may be accordian-pleated hollow plastic tubing.

Figure 3:
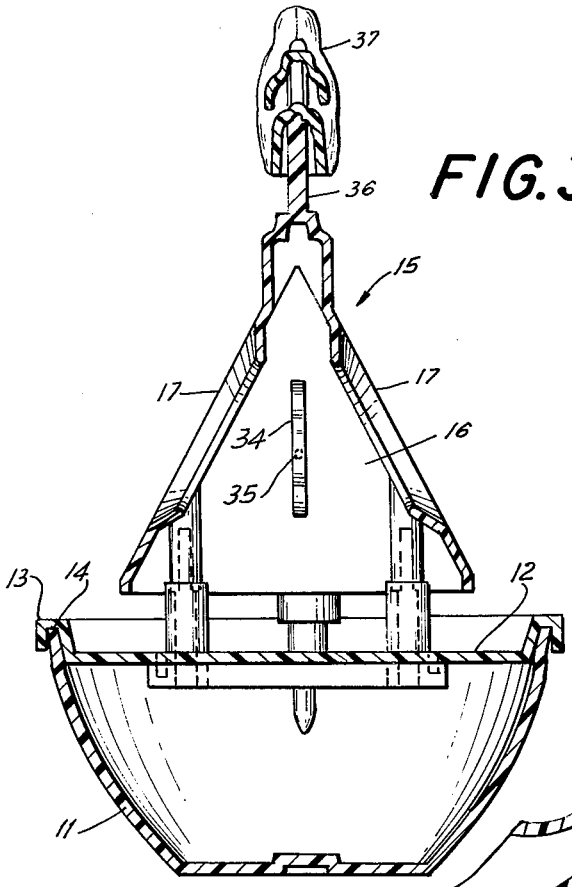
FIG. 3 is a vertical cross-sectional view taken along line 3—3 of FIG. 1.

Exposed through a hole 33 in each pitched side of roof 17 is a flattened target member 34 (FIGS. 1 and 3), resembling a cartoon character grasping a horizontal rod 35. The ends of rod 35 are journaled in walls 16 of cabin 15 so that target member 34 is rotatable about the axis of the rod. Mounted on the peak of roof 17 of the cabin is a simulated weathervane including a fixed vertical spindle 36 on which a target member 37 is rotatably mounted.

Each of the target members 21, 27, 31, 34, and 37 moves with respect to boat 10 upon being hit by a stream of water. Thus, when a stream of water passes through either of holes 25 and strikes vanes 24, target member 21 rotates about the vertical axis joining journals 22 and 23. A stream of water impinging upon propeller 27 causes it to rotate about the axis of post 26, and a stream passing through either hole 33 and striking target member 34 causes the latter to spin about the axis of rod 35. Target member 37 rotates about the axis of spindle 36 when hit by a water stream, and giraffe head 31 vibrates or oscillates when struck by a water stream. The target members illustrated and described are intended to be representative of many types of target members which could be employed to respond by movement to being struck by a stream of water.

Streams of water are produced by a pump means 40, which in the present example is a hollow plastic body having the appearance of a stylized porpoise. The porpoise wears a hat 41 of the type worn by the captains of old sailing ships. The rear brim of the hat defines a hook-like formation which fits over lip 13 at the front of boat 10 to removably mount pump means 40 on the boat in the fashion of a figurehead of an old sailing ship.

Pump means 40 is provided at its tail end with a water inlet 42 (FIG. 4), and its nose 43 defines a nozzle having an outlet opening 44. Between the inlet and outlet, pump means 40 has a squeezable bulbous belly portion 45. Both the inlet 42 and outlet 44 are furnished with one-way valves. Thus, a flap 46 of resilient material is fixed inwardly of inlet 42, such as by a rivet 47. The flap yields to permit flow of water into pump means 40, but seals inlet 42 to prevent water flow out of inlet 42. One end of a flattened tube 47, such as of soft rubber or plastic, is secured to outlet opening 44 and projects forwardly therefrom. The tube opens to permit water flow out of pump means 40, but flattens and closes to prevent flow of air or water into the pump means.

Figure 4:
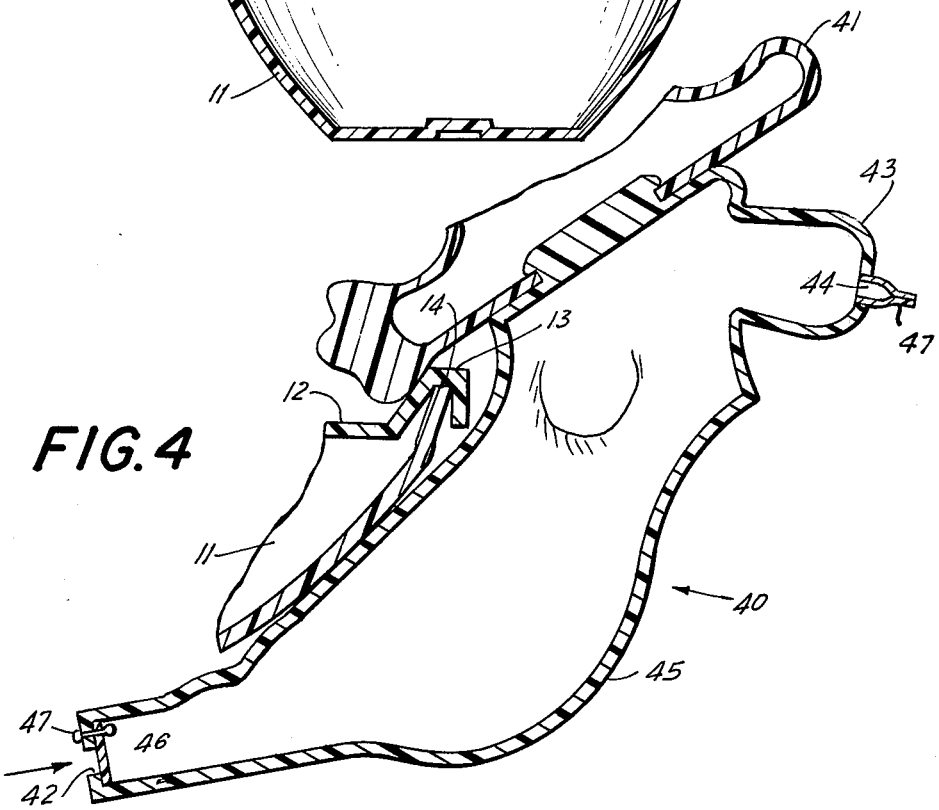
FIG. 4 is a longitudinal cross-sectional view, on an enlarged scale, of the pump means.

When pump means 40 is to be used, it is removed from its position on boat 10, shown in FIGS. 1 and 4, and held in one hand, preferably with the fingers overlying belly 45. The tail end including inlet 42 is submerged in the water on which boat 10 is floating, and nozzle 43 is aimed at a chosen target member. Belly 45 is then squeezed repeatedly to produce a pumping action. With each squeeze, the interior volume of pump means 40 is reduced thereby increasing the interior pressure, and each time belly 45 is released, the volume increases creating a partial vacuum. In response to each partial vacuum, water flows through inlet 42, past flap 46, into the interior of pump means 40. Air does not flow in through outlet 44 because the partial vacuum causes tube 47 to flatten and effectively close outlet 44. Once pump means 40 is filled with water, each squeeze forces a stream of water out of outlet 44 and through tube 47, the pressure causing the tube to open. The pressure within the pump means presses flap 46 against the wall surrounding inlet 42 and closes the inlet. The pump means can be used continuously to create streams of water in bursts as long as inlet opening 42 remains submerged.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A water toy comprising:

(a) a float capable of floating on the surface of a body of water, (b) at least one target member carried by the float and movable with respect to the float, (c) a manually-operable pump means for directing a stream of water at the target member, the pump means having an inlet submersible in the body of water on which the float floats for drawing water into the pump means while the latter is operated to produce a stream, and (d) means for removably mounting the pump means on the float when the pump means is not in use, said mounting means including a lip at the periphery of the float, and a hook-like formation on the pump means which fits over the lip.

* * * * *